US012589421B2

(12) United States Patent
Cha et al.

(10) Patent No.: US 12,589,421 B2
(45) Date of Patent: Mar. 31, 2026

(54) HAIRPIN COIL FLATTENING CONTROL SYSTEM AND METHOD THEREFOR

(71) Applicants: Hyundai Motor Company, Seoul (KR); Kia Corporation, Seoul (KR)

(72) Inventors: Taeuk Cha, Changwon-Si (KR); Taekyun An, Hwaseong-Si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 260 days.

(21) Appl. No.: 18/367,280

(22) Filed: Sep. 12, 2023

(65) Prior Publication Data

US 2024/0091834 A1 Mar. 21, 2024

(30) Foreign Application Priority Data

Sep. 20, 2022 (KR) ..... 10-2022-0118646

(51) Int. Cl.

| | |
|---|---|
| ***B21B 37/28*** | (2006.01) |
| ***B21C 51/00*** | (2006.01) |
| ***B21F 1/00*** | (2006.01) |
| ***B21F 1/02*** | (2006.01) |
| ***B21F 23/00*** | (2006.01) |
| ***B21F 45/00*** | (2006.01) |
| ***H02K 15/0421*** | (2025.01) |

(52) U.S. Cl.
CPC ..... *B21B 37/28* (2013.01)

(58) Field of Classification Search
CPC ..... B21B 37/28; B21C 51/00; B21F 1/004; B21F 1/023; B21F 23/00; B21F 45/00; H02K 15/0421
See application file for complete search history.

(56) References Cited

U.S. PATENT DOCUMENTS

2009/0139290 A1* 6/2009 Britanik ..... B21B 37/28 72/9.2
2017/0259313 A1* 9/2017 Fairlie ..... B21B 37/28

FOREIGN PATENT DOCUMENTS

EP 0730918 A1 * 9/1996 ..... B21D 1/02
KR 20210108649 A * 9/2021 ..... B21D 5/08

OTHER PUBLICATIONS

English translate (KR20210108649A), retrieved dater Jul. 21, 2025.*
English translate (EP0730918A1), retrieved dater Jul. 21, 2025.*

* cited by examiner

*Primary Examiner* — Mohammed S. Alawadi
(74) *Attorney, Agent, or Firm* — Banner & Witcoff, Ltd.

(57) ABSTRACT

A system for processing a rectangular material from a coil is provided. The system may include an unwinding unit configured to unwind a rectangular material from a coil wound on a bobbin, a flattening device configured to flatten the unwound rectangular material, a shaping device configured to transform the flattened rectangular material into a shaped hairpin configuration; a reader configured to recognize, based on scanning an identification code of the bobbin mounted on the unwinding unit, batch information, and a controller configured to store, based on the batch information, a reference graph of a pressing amount for each batch of the bobbin set through a test; calculate, based on the stored reference graph and a change in physical properties of a rectangular material, a pressing amount for a rectangular material; and selectively control, based on the calculated pressing amount, a pressing amount of an individual flattening roller of flattening rollers.

20 Claims, 9 Drawing Sheets

<Coil flattening failure>

<Coil shapeability failure>

<Stress-Strain Curve>

| Amount of pressing (mm) | Tensile strength (Mpa) | Yield strength (Mpa) | Elongation rate (%) | Thickness (mm) | Width (mm) | Straightness (mm) |
|---|---|---|---|---|---|---|
| Bobbin | 218.85 | 119.32 | 47.76 | 1.69 | 3.29 | - |
| Nominal (0) | 220.76 | 121.54 | 47.63 | 1.68 | 3.28 | 3.32 |
| + 1.0 | 228.65 | 165.11 | 42.26 | 1.65 | 3.24 | 14.26 |
| + 2.0 | 236.82 | 190.81 | 35.76 | 1.62 | 3.19 | 53.22 |

<Relationship of coil physical properties and shapeability>

<Pressing amount adjustment test>

| Classification | Yield strength | | |
|---|---|---|---|
| | LOT 255-2 | LOT 352-1 | LOT 352-2 |
| Bobbin | 95.0 | 97.4 | 93.0 |
| 1mm x 1ea | 127.0 | 129.7 | 125.0 |
| 2mm x 1ea | 139.6 | 143.8 | 138.4 |
| 3mm x 1ea | 149.8 | 156.4 | 146.5 |

<Yield strength data analysis based on amount of pressing>

<Reference graph of an amount of pressing for each LOT of bobbins>

HAIRPIN COIL FLATTENING CONTROL SYSTEM AND METHOD THEREFOR

CROSS-REFERENCE TO RELATED APPLICATION

This application claims priority to and the benefit of Korean Patent Application No. 10-2022-0118646 filed in the Korean Intellectual Property Office on Sep. 20, 2022, the entire contents of which are incorporated herein by reference.

TECHNICAL FIELD

The present disclosure relates to a hairpin coil flattening control system and a method therefor, and more particularly, to a hairpin coil flattening control system and a method therefor for setting an amount of pressing of a roller during a flattening operation.

BACKGROUND

In general, an electric vehicle (xEV) uses a motor (permanent magnet synchronous motor (PMSM)) as a drive source, and a high output of the motor is used to secure the market competitiveness of the electric vehicle.

The output of the motor may be proportional to the number of turns of coils wound on a stator core, but there may be a disadvantage that a size of the motor inevitably increases if the number of turns of the coils is increased, and therefore the number of turns of the coils may not be increased infinitely. Therefore, in order to reduce or minimize the size of the motor and efficiently improve the output of the motor, a solution is being considered to increase a space factor by reducing or minimizing a dead space between the coils wound on the core of the stator.

Instead of using a round coil with a circular cross-section (also referred to as a "round wire coil"), a flat rectangular hairpin coil (also referred to as a "flat rectangular wire coil") with a rectangular cross-section may be applied to produce a hairpin type of stator.

FIG. 9 shows an example of a stator structure with a flat rectangular hairpin coil.

With reference to FIG. 9, a hairpin type of stator 20 has a winding structure by inserting a plurality of flat rectangular coils 11 into slots 22 formed in a stator core 21. The hairpin coil 11 may be shaped in a U-shape or V-shape and may reduce dead spaces between the coils and increase a space factor compared to other round coil due to characteristics of having a rectangular cross-section.

However, since the hairpin coil 11 may be manufactured to have a wider cross-sectional area than the round coil in order to increase or maximize the space factor, stiffness may be increased. Therefore, it may be difficult to apply a coil winding method using a winding machine.

Therefore, since the hairpin coil 11 may have a characteristic of being inserted into the slot 22 in large quantities if the stator 20 is manufactured, uniformly flattening the hairpin coil 11 is desirable for the purpose of straightening in the shaping (production) process.

For example, in a hairpin coil shaping method, a flattening operation may be performed in which a flat rectangular coil wound on a bobbin is unwound by an unwinding unit, and flat rectangular coil may be allowed to pass through a flattening device installed correspondingly on upper and lower surfaces and left and right surfaces of the flat rectangular coil.

The flattening operation may be managed in a manner in which the flatness (hereinafter, having the same meaning as straightness) of the flat rectangular coil is adjusted by disposing in parallel a plurality of flattening rollers in the flattening device in upward and downward directions and in leftward and rightward directions, and setting an amount of pressing of the flattening rollers by an experienced operator.

However, since the flattening operation may be manually adjusting the amount of pressing by the operator determining the straightening shape of the coil with visual inspection, without a definite standard for setting the amount of pressing of the roller, the flattening operation may rely on the experience (know-how) of the operator. Therefore, there may be a problem in that a hairpin shaping dispersion (quality degradation) may be caused due to human error of the operator, which may decrease quality and operating rate of a stator production line.

The above information disclosed in this Background section is only for enhancement of understanding of the background of the invention and does not form the prior art.

SUMMARY

According to the present disclosure, a system for processing a rectangular material from a coil, the system may comprise: an unwinding unit configured to unwind a rectangular material from a coil wound on a bobbin; a flattening device configured to flatten, based on passing the unwound rectangular material through flattening rollers, the unwound rectangular material, wherein the flattening rollers are positioned on upper and lower sides of the unwound rectangular material and on left and right sides along a lengthwise direction of the unwound rectangular material; a shaping device configured to transform the flattened rectangular material into a "U" shaped hairpin configuration; a reader configured to recognize, based on scanning an identification code of the bobbin mounted on the unwinding unit, batch information; and a controller configured to: store, based on the batch information, a reference graph of a pressing amount for each batch of the bobbin set through a test; calculate, based on the stored reference graph and a change in physical properties of the rectangular material, a pressing amount for the rectangular material; and selectively control, based on the calculated pressing amount, a pressing amount of an individual flattening roller of the flattening rollers.

The controller may be further configured to, based on a tensile test for each batch and the pressing amount of the rectangular material, analyze yield data; based on the analyzed yield data, generate the reference graph as a graph including an optimal target yield strength for each batch. The flattening device may comprise a first flattening unit having a first plurality of flattening rollers disposed based on a thickness of the rectangular material, wherein the first plurality of flattening rollers are configured to flatten upper and lower surfaces of the rectangular material; and a second flattening unit having a second plurality of flattening rollers disposed based on a width of the rectangular material, wherein the second plurality of flattening rollers are configured to flatten left and right surfaces of the rectangular material.

The first plurality of flattening rollers may comprise: a plurality of first flattening rollers positioned on an upper portion of the rectangular material; an individual adjuster installed on each of the plurality of first flattening rollers to independently adjust a position of each of the plurality of first flattening rollers; a plurality of second flattening rollers positioned on a lower portion of the rectangular material;

and an integrated adjuster configured to simultaneously adjust positions of the plurality of second flattening rollers.

The individual adjuster may be configured to adjust, based on a control signal applied from the controller through a servo motor, a flattening roller to a pressing amount in units of micrometers. The integrated adjuster may be configured to: connect the plurality of second flattening rollers in parallel through a frame rod; and adjust, based on an applied control signal, the plurality of second flattening rollers simultaneously to be raised to a clamp position or lowered to an unclamp position.

The controller may be configured to: derive, based on the batch information, an initial yield strength of the rectangular material; derive, based on the reference graph, a target yield strength corresponding to the batch information; and determine, based on a deviation of the initial yield strength from the target yield strength, a maximum pressing amount of an individual roller.

The controller, in a state of a plurality of flattening rollers, positioned on the lower side of the rectangular material, fixed in a clamp position, may be configured to: based on a direction of rectangular material feeding among a plurality of flattening rollers positioned on the upper side of the rectangular material, control a first roller to apply the maximum pressing amount; and subsequently control, based on a thickness of the rectangular material, the remaining rollers of the plurality of flattening rollers disposed on the upper side of the rectangular coil, to apply a pressing amount of a nominal value.

The controller, in a state of a plurality of flattening rollers, positioned on the lower side of the rectangular material, fixed in a clamp position, may be configured to: based on a direction of rectangular material feeding among a plurality of first flattening rollers positioned on the upper side of the rectangular material, control a first roller to apply the maximum pressing amount; control, based on a thickness of the rectangular material, subsequent rollers of the plurality of first flattening rollers positioned on the upper side to apply a pressing amount of a nominal value; and control, based on a fine-adjusted pressing amount, a last roller of the plurality of first flattening rollers positioned on the upper side.

According to the present disclosure, a method for processing a rectangular material from a coil, the method may comprise: identifying, by a reader and based on batch information on a bobbin mounted on an unwinding unit, information on physical properties of the rectangular material; disposing, based on a thickness and a width of the rectangular material through a flattening device, a plurality of flattening rollers at clamp positions of upper and lower sides of the rectangular material and left and right sides of the rectangular material; based on an initial yield strength of the coil based on the batch information and a reference graph of a pressing amount for each batch of the bobbin, deriving a target yield strength corresponding to the batch information; and determining, based on based on a deviation of the initial yield strength from the target yield strength, a maximum pressing amount of an individual flattening roller of the plurality of flattening rollers; and controlling, based on the maximum pressing amount, the individual flattening roller.

The disposing of the plurality of flattening rollers at the clamp positions may comprise: disposing horizontally a plurality of first flattening rollers on the upper side of the rectangular material through individual adjusters; and disposing a plurality of second flattening rollers horizontally on the lower side of the rectangular material by collectively raising the plurality of second flattening rollers through an integrated adjuster.

The controlling the individual flattening roller may comprise: fixing, through the integrated adjuster, the plurality of second flattening rollers to apply an pressing amount of a nominal value; and based on a direction of rectangular material feeding among the plurality of first flattening rollers, controlling, through the individual adjusters, a first roller of the plurality of first flattening rollers to apply the maximum pressing amount; and subsequently controlling, based on the thickness of the rectangular material, the remaining rollers of the plurality of first flattening rollers to apply a pressing amount of a nominal value.

The method may further comprise: based on the controlling of the remaining rollers and controlling a fine-adjusted amount of pressing of a last roller of the plurality of first flattening rollers, compensating for a hairpin dispersion of a flatness test result received from a flatness tester.

DETAILED DESCRIPTION

Figure 1:
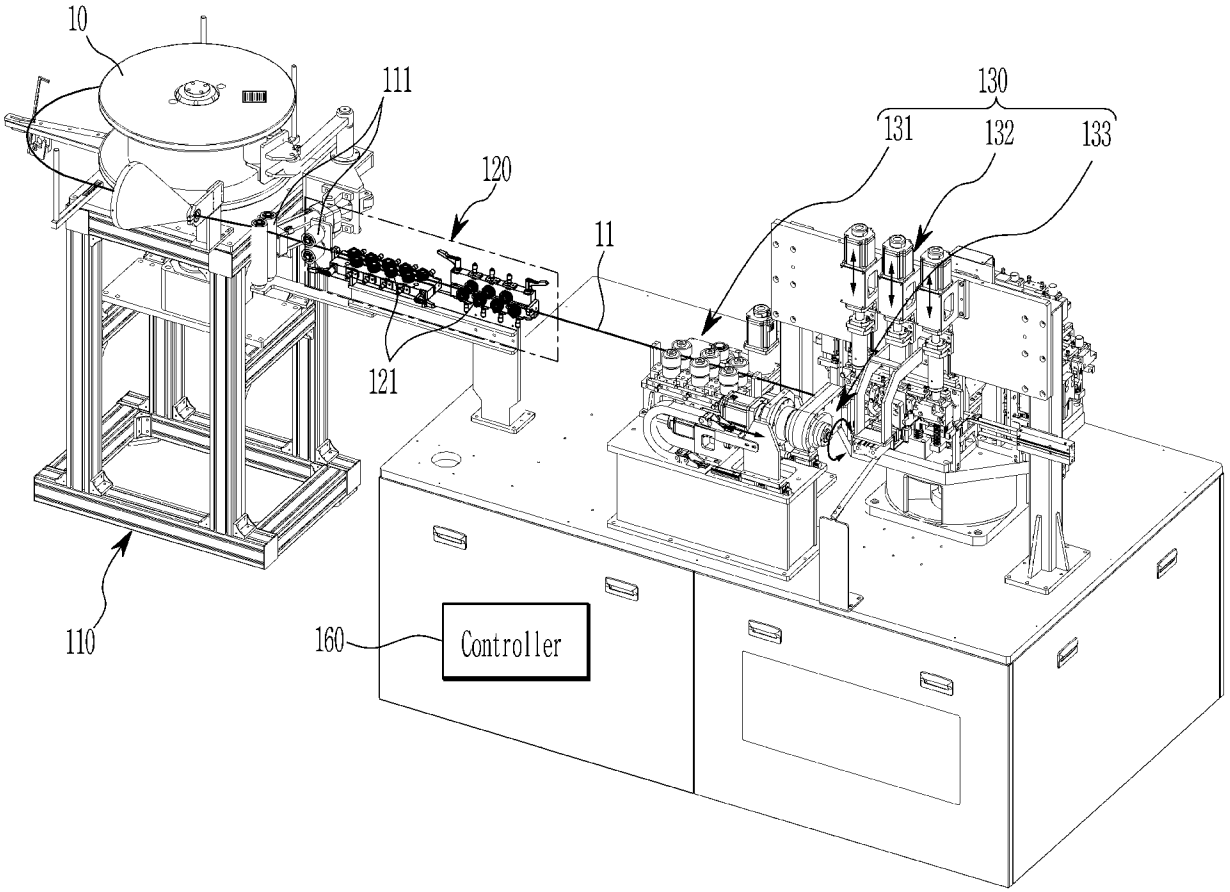
FIG. 1 shows an example of a production facility for a flat rectangular hairpin according to an example of the present disclosure.

Hereinafter, an example of the present disclosure will be described in detail with reference to the accompanying drawings so that those skilled in the technical field to which the present disclosure pertains may easily carry out the example.

The terms used herein are merely for the purpose of describing a specific example, and not intended to limit the present disclosure. The singular expressions used herein are intended to include the plural expressions unless the context clearly dictates otherwise. It is to be understood that the term "comprise (include)" and/or "comprising (including)" used in the present specification means that the features, the integers, the steps, the operations, the constituent elements, and/or component are present, but the presence or addition or alternative of one or more of other features, integers, steps, operations, constituent elements, components, and/or groups thereof is not excluded. The term "and/or" used herein includes any one or all the combinations of listed related items.

Throughout the specification, the terms such as "first," "second," "A," "B," "(a)," "(b)," and other numerical terms may be used herein only to describe various elements, but these elements should not be limited by these terms. These terms are used only for the purpose of discriminating one constituent element from another constituent element, and the nature, the sequences, or the orders of the constituent elements are not limited by the terms.

Throughout the specification, if one constituent element is described as being "connected" or "coupled" to another constituent element, it should be understood that one constituent element can be connected or coupled directly to another constituent element, and an intervening constituent element can also be present between the constituent elements. If one constituent element is described as being "connected directly to" or "coupled directly to" another constituent element, it should be understood that no intervening constituent element is present between the constituent elements.

Additionally or alternatively, it is understood that one or more of the following methods or examples thereof may be executed by one or more controllers. The term "controller" can refer to a hardware device that includes a memory and a processor. The memory is configured to store program instructions, and the processor is specifically programmed to execute the program instructions to perform one or more of the processes described in more detail below. The controller may control the operation of units, modules, components, devices, or the like, as described herein. It is understood that the methods below may be carried out by an apparatus comprising the controller in conjunction with one or more other components, as recognized by those skilled in the art.

In addition or alternative, the controller of the present disclosure may be implemented as a non-transitory computer-readable recording medium including executable program instructions executed by a processor. Examples of computer-readable recording media include, but are not limited to, ROMs, RAMs, compact disc (CD) ROMs, magnetic tapes, floppy disks, flash drives, smart cards, and optical data storage devices.

A hairpin coil flattening control system and a method therefor according to an example of the present disclosure will be described in detail with reference to the drawings.

FIG. 1 shows an example of a production facility for a flat rectangular hairpin according to an example of the present disclosure.

With reference to FIG. 1, a production facility for a flat rectangular hairpin according to an example of the present disclosure includes an unwinding unit 110 that unwinds a flat rectangular coil 11 wound on a bobbin 10, a flattening device 120 that performs a flattening (straightening) operation by passing the flat rectangular coil 11 through a flattening roller 121 disposed in plural vertically and horizontally along a lengthwise direction, respectively, and a shaping device 130 for shaping the flattened rectangular coil 11 into a "U" shaped hairpin coil 11. Hereinafter, the coil is divided into a flat rectangular coil 11 before shaping and a hairpin coil 11 after shaping that are represented by the same reference numeral.

A guide unit 111 is provided between the unwinding unit 110 and the flattening device 120 to introduce the unwound flat rectangular coil 11 into the flattening roller 121 without interference.

The shaping device 130 includes a coil feeding module 131 that feeds the flattened flat rectangular coil 11 for the shaping operation, a coil pressing module 132 that presses the fed flat rectangular coil 11 to shape the flat rectangular coil 11 into a "U" shaped hairpin coil 11, and a coil cutting module 133 that cuts the hairpin coil 11 into a predetermined length. The coil pressing module 132 may produce the hairpin coil 11 with a desired shape by stamping the hairpin using a mold.

The flat rectangular coil 11 has a rectangular cross-section including upper, lower, left, and right surfaces, and the flattening operation must be performed before shaping due to the characteristics that the shaped hairpin coil 11 is to be shaped into a pair of straightened "U" shaped hairpin types.

If there is failure in the flatness (straightness) of the flat rectangular coil 11 because the flattening operation is not performed properly in the production facility for the flat rectangular hairpin, there is a high probability of occurrence of failure in the hairpin coil 11 that is subsequently shaped. If a new bobbin 10 is replaced in the unwinding unit 110, if the physical properties of the flat rectangular coil 11 finely vary depending on the LOT, or if failure occur in the flatness, it may take a lot of time to adjust a setting value of the flattening roller 121, which decreases an operating rate. Therefore, it is very important to properly control the flattening operation in order to improve the quality and operating rate of the hairpin coil 11.

Figure 2:
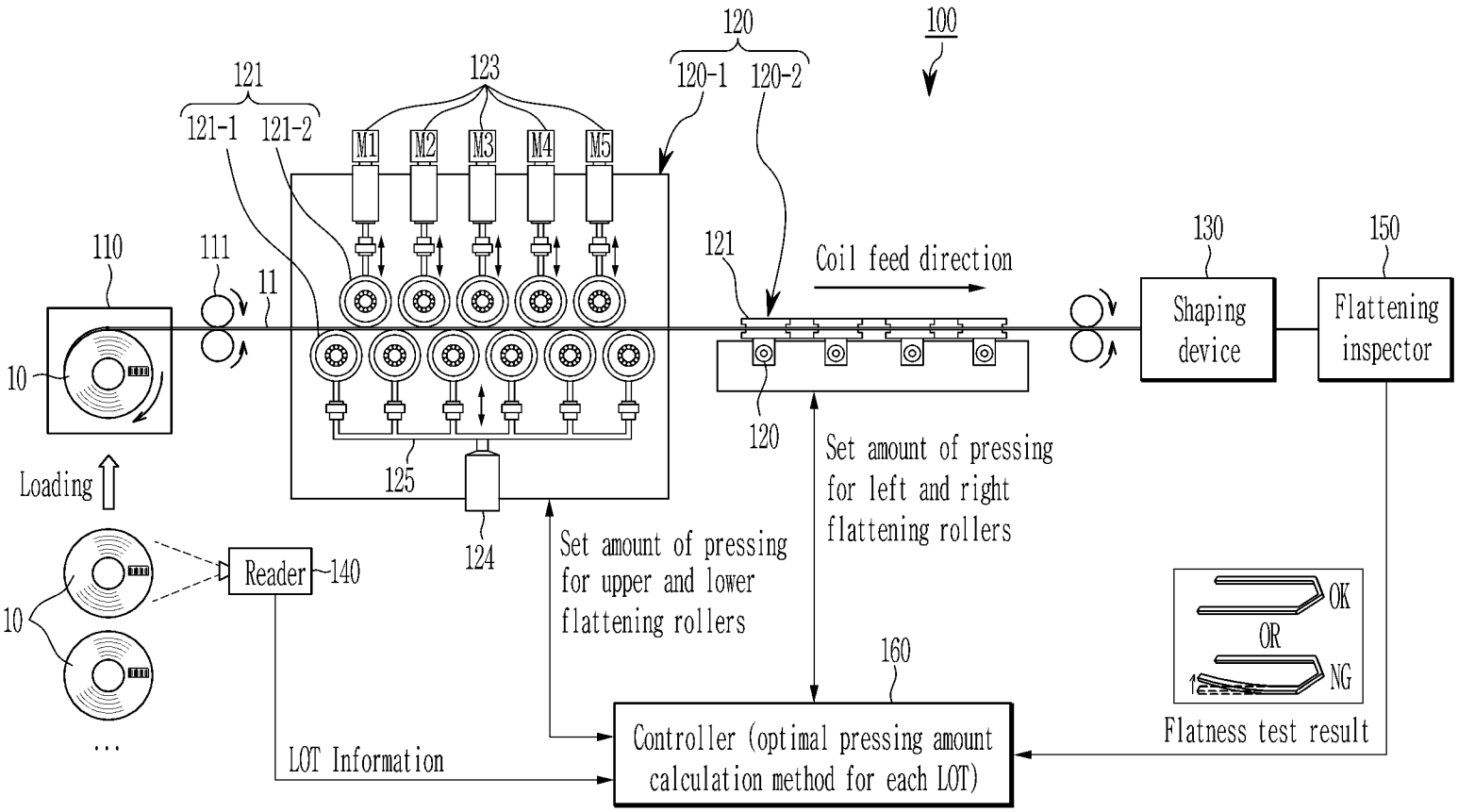
FIG. 2 shows an example of a hairpin coil flattening control system applied to the production facility for a hairpin according to an example of the present disclosure.

Meanwhile, FIG. 2 shows an example of a hairpin coil flattening control system applied to the production facility for a hairpin according to an example of the present disclosure.

With reference to FIG. 2, a hairpin coil flattening control system 100 according to an example of the present disclosure includes a reader 140, a flatness inspector 150, and a controller 160 applied to the production facility for hairpins including the previously described unwinding unit 110, flattening device 120, and shaping device 130.

The flattening device 120 includes a first flattening unit 120-1 and a second flattening unit 120-2.

The first flattening unit 120-1 has a plurality of flattening rollers 121 disposed horizontally on upper and lower portions thereof based on a thickness of the flat rectangular coil 11 and flattens the upper and lower surfaces of the flat rectangular coil 11.

The second flattening unit 120-2 has the plurality of flattening rollers 121 disposed horizontally on left and right portions thereof based on a width of the flat rectangular coil 11 and flattens the left and right surfaces of the flat rectangular coil 11.

Hereinafter, in the description, upper and lower sides (thickness) of the flat rectangular coil 11 are to be understood as a direction in which the flat rectangular coil 11 is wound relative to the bobbin 10, and left and right sides (width) are to be understood as a direction of a rotational axis of the bobbin 10.

The first flattening unit 120-1 includes a plurality of first flattening rollers 121-1 positioned on an upper portion thereof relative to the flat rectangular coil 11, individual adjusters 123 installed on each of the plurality of first flattening rollers 121-1 to independently adjust a position of each of the plurality of first flattening rollers 121-1, a plurality of second flattening rollers 121-2 positioned at a lower portion of the flat rectangular coil 11, and an integrated adjuster 124 that simultaneously adjusts positions of the plurality of second flattening rollers 121-2.

As described above, the first flattening unit 120-1 and the second flattening unit 120-2 have similar configurations in that the first and second flattening units 120-1 and 120-2 differ in positions in which the first and second flattening units 120-1 and 120-2 are installed with states of being 90 degrees twisted from each other on the upper and lower sides and the left and right sides of the flat rectangular coil 11, respectively, and flatten respective contact surfaces of the flat rectangular coil 11 through the plurality of flattening rollers 121 disposed thereon. Therefore, hereinafter, the configuration of the first flattening unit 120-1 will be described as representative, and the repeated description of the second flattening unit 120-2 will be omitted.

The plurality of first flattening rollers 121-1 and the plurality of second flattening rollers 121-2 are disposed in a zigzag pattern along the lengthwise direction of the flat rectangular coil 11.

Each of the individual adjusters 123 may adjust the corresponding first flattening roller to an amount of pressing in units of micrometers in response to a control signal applied from the controller 160 through a servo motor M1, M2, M3, M4, or M5.

The integrated adjuster 124 connects the plurality of second flattening rollers 121-2 in parallel through a frame rod 125 and may adjust the plurality of second flattening rollers 121-2 simultaneously to be raised to the coil clamp position or lowered to the coil unclamp position in response to the applied control signal.

The order of disposition of the first flattening unit 120-1 and the second flattening unit 120-2 and the number of installations of the flattening rollers 121 may vary depending on the size of the flat rectangular coil 11 and the installation company.

The reader 140 recognizes LOT (e.g., batch) information by scanning an identification code (bar code/QR code) of the bobbin 10 mounted on the unwinding unit 110, and transmits the recognized LOT information to the controller 160. The LOT information is identification information (ID) on a product production unit of the flat rectangular coil 11, and has uniform physical properties and manufacturing dispersion by being manufactured with the same raw material and process.

The flatness inspector 150 measures the flatness with respect to the lengthwise direction of the hairpin coil 11 produced through the shaping device 130 and transmits the measured flatness to the controller 160.

The flatness tester 150 may measure the flatness in a non-contact manner using a laser displacement sensor or image sensor, or in a contact manner in which a probe is contacted to measure changes in height.

The controller 160 controls an overall operation of the hairpin coil flattening control system 100 according to an example of the present disclosure. The controller 160 may control the constituent elements included in the hairpin coil flattening control system 100, including a computer that includes hardware and software or a main programmable logic controller (PLC).

The controller 160 generates and stores a graph of an optimized reference amount of pressing for each LOT through a flattening test using various LOT information on the flat rectangular coil 11 in advance. Further, upon receiving the LOT information from the reader 140, the amount of pressing of the individual flattening roller 121 is selectively controlled by calculating the amount of pressing by considering the change in the physical properties of the corresponding flat rectangular coil 11 based on the reference graph of an amount of pressing for each LOT.

Hereinafter, a test process for controlling hairpin coil flattening according to an example of the present disclosure will be briefly described.

Figure 3:
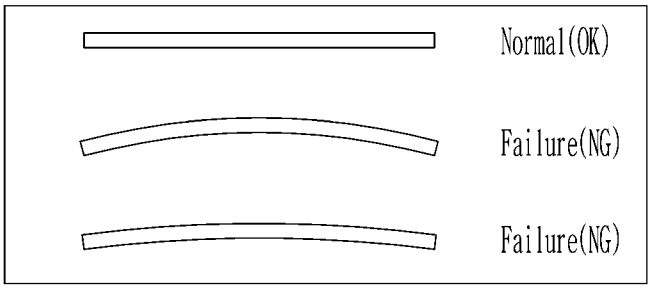
FIG. 3 shows an example of a failure case based on an amount of pressing and physical properties of a flat rectangular coil according to a test of the present disclosure.
Figure 3:
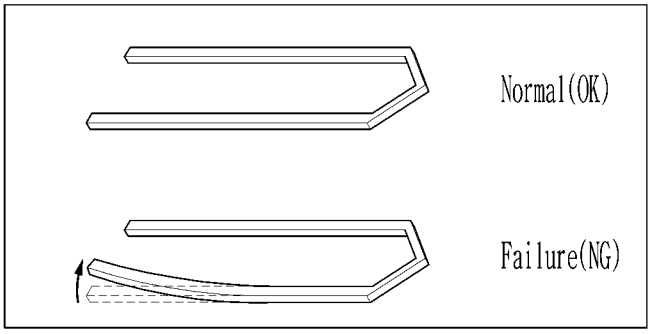

FIG. 3 shows an example of a failure case based on an amount of pressing and physical properties of the coil according to a test of the present disclosure.

With reference to FIG. 3, if the amount of pressing of the flattening rollers 121 is set without a definite standard, flat rectangular coil flattening failure (NG) occurs, which leads to hairpin coil shaping failure (NG). For example, the greater the amount of pressing of the flattening roller 121, the more the flat rectangular coil 11 is bent, and if shaping with the more bent coil, legs of the hairpin coil 11 are lifted.

Therefore, it is very important to establish a setting standard for the amount of pressing of the flattening rollers 121 if flattening a flat rectangular coil. Since the amount of pressing is highly related to the physical properties of the flat rectangular coil, the amount of pressing should be calculated in consideration with the physical properties of the flat rectangular coil.

In the process of flattening the flat rectangular coil 11 of a form wound on the bobbin 10, deformation of a conductor (copper) in the coil occurs, and yield strength of the physical properties increases according to the deformation.

Figure 4:
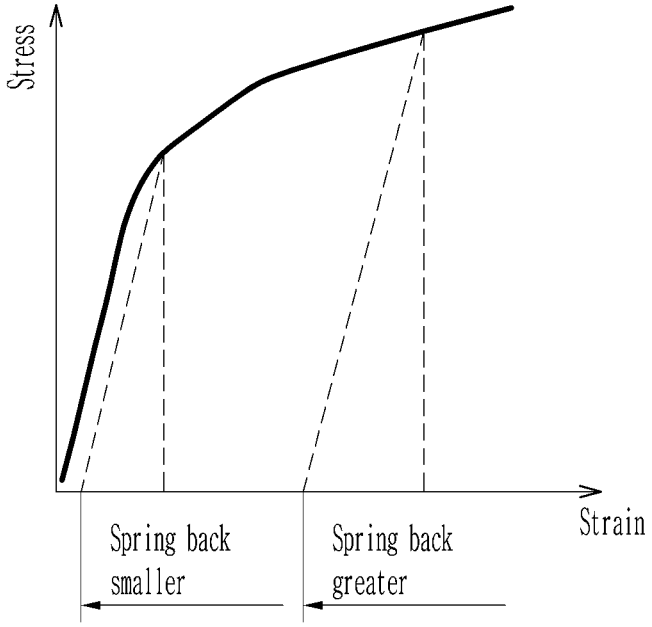
FIG. 4 shows an example of a stress-strain curve of a coil according to the test of the present disclosure.

FIG. 4 shows an example of a stress-strain curve of a coil according to the test of the present disclosure.

With reference to FIG. 4, as shown in the stress-strain curve, since the rectangular shaped coil 11 has the greater spring back as the yield strength is higher, the amount of pressing (i.e., yield strength) of the flattening roller 121 may be managed in order to stabilize the shaping quality.

Figure 5:
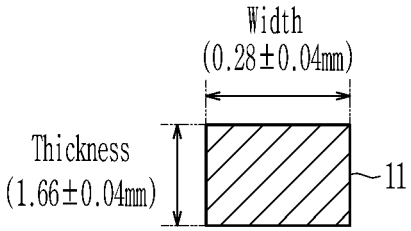
FIG. 5 shows an example of a relationship between physical properties of the coil and linearity based on the test of the present disclosure.
Figure 5:
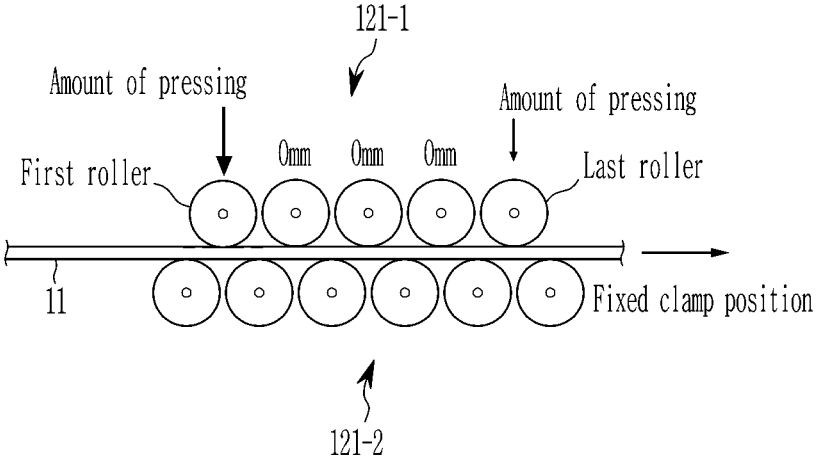

FIG. 5 shows an example of a relationship between physical properties of the coil and linearity based on the test of the present disclosure.

With reference to FIG. 5, the relationship between the physical properties and shapeability of the flat rectangular coil 11 through the test shows that the increasing amount of pressing of the flattening roller 121 increases the change in the physical properties of the flat rectangular coil 11 and worsens the straightness. Here, the change in physical properties includes a phenomenon of increasing the tensile strength and yield strength of the flat rectangular coil 11 and a phenomenon of decreasing the elongation rate, thickness, and width.

There may be a tendency of increasing the shaping dimensions and shaping dispersion in accordance with the increase in the change in the physical properties if the amount of pressing of the flattening roller 121 is increased.

If only the flattening (straightening) example of the flat rectangular coil 11 is considered, it may be advantageous to set a nominal value (i.e., an amount of pressing of 0 mm) for the entire flattening rollers 121 to be in contact with the flat rectangular coil 11 to match a thickness and a height of the flat rectangular coil 11.

However, if the shapeability dispersion is considered as well as the flattening of the flat rectangular coil 11, i the amount of pressing may be calculated to reduce the dispersion of physical properties while proceeding with the flattening.

Meanwhile, as a result of performing the test while adjusting the amount of pressing of the individual flattening rollers 121 of the flattening device 120, it was confirmed that there is a tendency of decreasing the dispersion of the yield strength and constantly increasing the yield strength compared to the flat rectangular coil 11 before flattening, depending on the amount of pressing of the flattening rollers 121.

However, since the spring back becomes greater as the physical properties increase, resulting in poor shapeability, the flattening roller 121 is set to be pressed as little as possible, a reference graph of an amount of pressing for each LOT was derived with the suitable amount of pressing in order to reduce the dispersion of the physical properties considering the LOT information on the bobbin 10.

Figure 6:
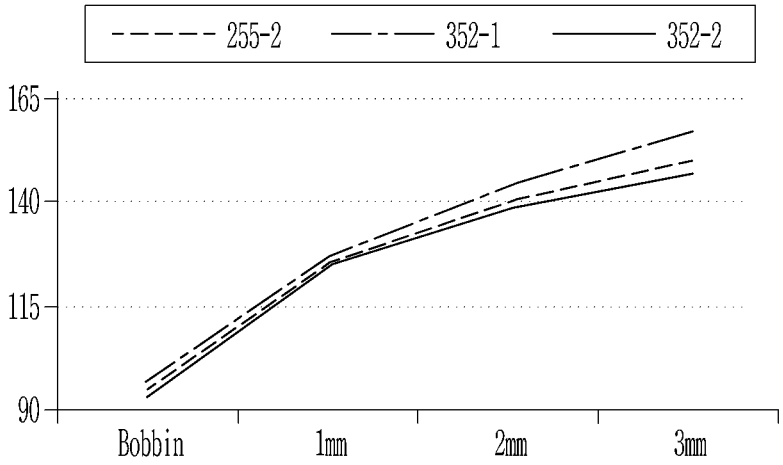
FIG. 6 shows an example of a reference graph of an amount of pressing for each LOT of bobbins, according to an example of the present disclosure.

For example, FIG. 6 shows an example of a reference graph of an amount of pressing for each LOT of bobbins, according to an example of the present disclosure.

With reference to FIG. 6, the reference graph of an amount of pressing for each LOT of bobbins according to an example of the present disclosure is generated as a graph including an optimal target yield strength for each LOT by analyzing yield data according to the amount of pressing of the flat rectangular coil 11 for each LOT after performing a tensile test of the flat rectangular coil 11 for each bobbin (e.g., 1 mm×1ea, 2 mm×1ea, and 3 mm×1ea) of various bobbin LOTs (255-2, 352-1, and 352-2).

The controller 160 derives an initial yield strength of the flat rectangular coil 11 based on LOT information on the bobbin 10, derives a target yield strength corresponding to the LOT information by referring to the reference graph of an amount of pressing for each LOT, and determines a maximum amount of pressing (e.g., 1 mm) of an individual roller by calculating a deviation of the initial yield strength from the target yield strength.

The controller 160, in a state of fixing the plurality of second flattening rollers 121-2 in the clamp position, controls a first roller of the plurality of first flattening rollers 121-1 to the maximum amount of pressing (1 mm) based on the direction of coil feeding, and subsequently controls the remaining rollers to a nominal value (0 mm) considering the thickness of the corresponding flat rectangular coil 11.

In addition or alternative, the controller 160 may control the first roller of the plurality of first flattening rollers 121-1 to the maximum amount of pressing (1 mm) based on the direction of coil feeding, control subsequent rollers to the nominal value (0 mm) considering the thickness of the corresponding flat rectangular coil 11, and control a last roller with a fine-adjusted amount of pressing. Here, the fine-adjusted amount of pressing may be set within a range of being less than the maximum amount of pressing and greater than the nominal value, for example, may be set as an adjustment value considering the dispersion of the result of the flatness test.

The controller 160 may be implemented as one or more processors operating by a set program, in which the set program is programmed to perform each step of a hairpin coil flattening control method according to an example of the present disclosure.

The description of this controller 160 will be described more specifically through a hairpin coil flattening control method with reference to the drawings below.

Figure 7:
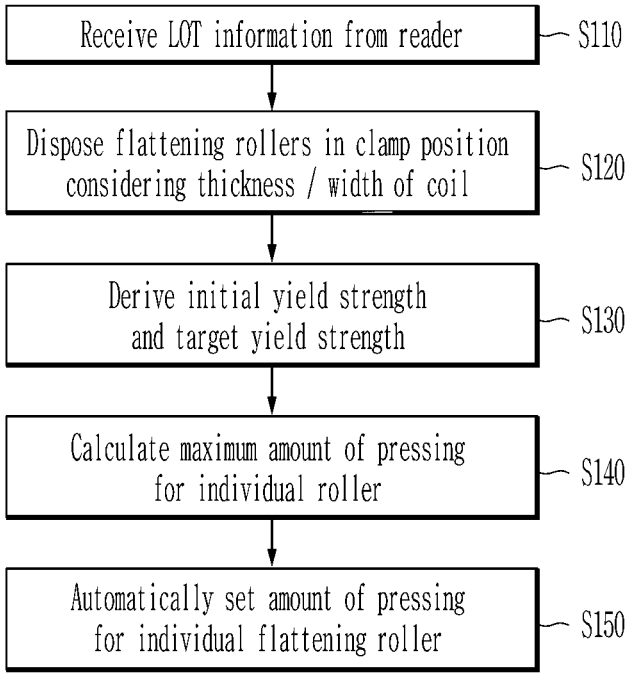
FIG. 7 shows an example of a flowchart showing steps of a hairpin coil flattening control method according to an example of the present disclosure.

FIG. 7 shows an example of a flowchart showing steps of a hairpin coil flattening control method according to an example of the present disclosure.

Figure 8:
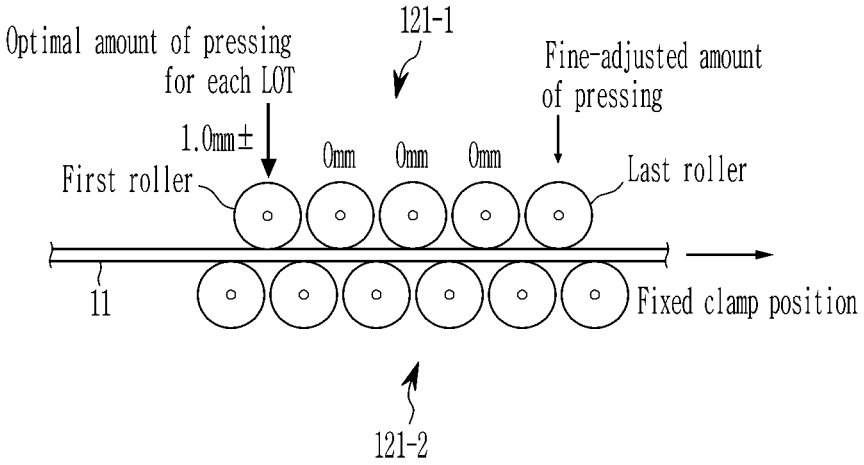
FIG. 8 shows an example of a method of setting an amount of pressing of a flattening roller according to an example of the present disclosure.
Figure 9:
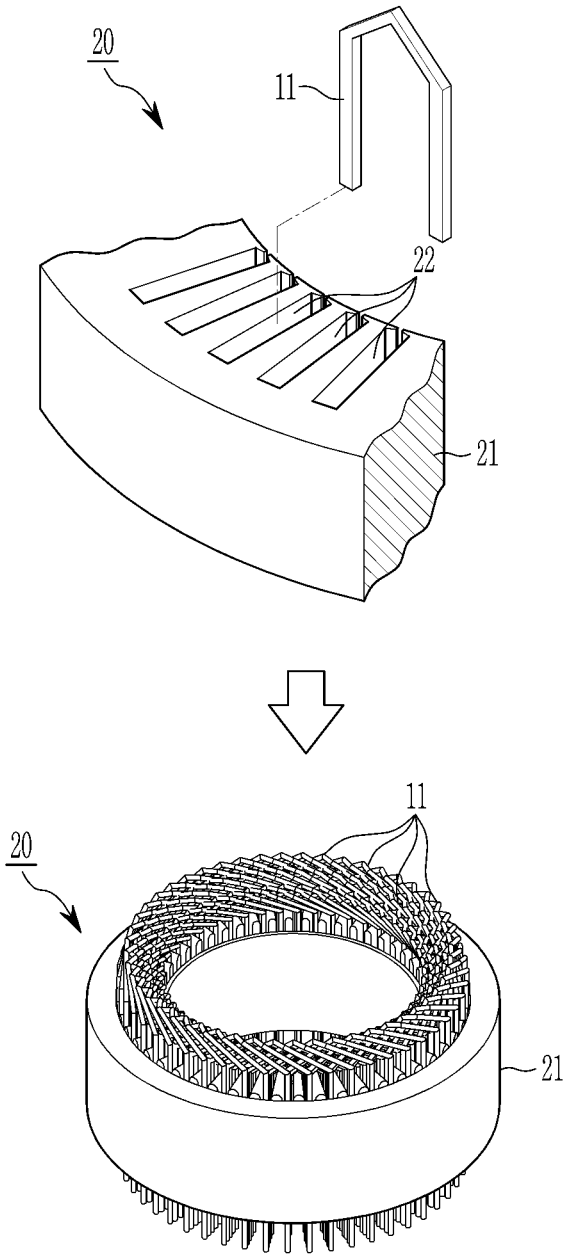
FIG. 9 shows an example of a stator structure with a flat rectangular hairpin coil.

FIG. 8 shows an example of a method of setting an amount of pressing of a flattening roller according to an example of the present disclosure.

With reference to FIGS. 7 and 8, a hairpin coil flattening control method according to an example of the present disclosure will be described by assuming a scenario in which an operator scans LOT information on a bobbin through the reader 140 if a new bobbin 10 is loaded into the unwinding unit 110 or replaced.

The controller 160 of the hairpin coil flattening control system 100, upon receiving LOT information recognized from the reader 140, identifies information on physical properties such as thickness, width, tensile strength, and yield strength of the flat rectangular coil 11 based on the set LOT information (S110).

The controller 160 performs a setting of the plurality of flattening rollers 121 provided in the flattening device 120 in the process as described below using the LOT information and the reference graph of an amount of pressing for each LOT of bobbins.

The controller 160 disposes the plurality of flattening rollers 121 in clamp positions of the upper and lower sides and the left and right sides considering the thickness and width of the flat rectangular coil 11 (S120) through the flattening device 120.

For example, the controller 160 may dispose the plurality of first flattening rollers 121-1 on the upper portion of the flat rectangular coil 11 through individual adjusters 123 of the first flattening unit 120-1, and fix in a state of being horizontal the plurality of second flattening rollers 121-2 on the lower portion of the flat rectangular coil 11 by collectively raising the plurality of second flattening rollers 121-2 through the integrated adjuster 124. Similarly, the controller 160 may dispose the plurality of first flattening rollers 121-1 on the left portion of the flat rectangular coil 11 through individual adjusters 123 of the second flattening unit 120-2, and fix in a state of being horizontal the plurality of second flattening rollers 121-2 on the right portion of the flat rectangular coil 11 by collectively raising the plurality of second flattening rollers 121-2 through the integrated adjuster 124.

The controller 160 identifies the initial yield strength of the flat rectangular coil 11 based on the LOT information, and derives a target yield strength corresponding to the LOT information (S130) by referring to the reference graph of an amount of pressing for each LOT of the bobbin.

The controller 160 determines a maximum amount of pressing of the individual roller (e.g., 1 mm) by calculating a deviation of the initial yield strength from the target yield strength (S140), and automatically controls the amount of pressing of the individual flattening roller 121 based on the maximum amount of pressing (S150).

In this case, the controller 160 fixes the plurality of second flattening rollers 121-2 at the clamp positions with a nominal value (e.g., 0 mm) through the integrated adjuster 124. Further, the individual adjuster 123 controls the first roller to the maximum amount of pressing (e.g., 1 mm) based on the direction of coil feeding among a plurality of first flattening rollers 121-1, and, subsequently, controls the remaining rollers to the nominal value (0 mm) considering the thickness of the corresponding flat rectangular coil 11.

Thereafter, the controller 160 may control a fine-adjusted amount of pressing of a last roller of the plurality of first flattening rollers 121-1 in order to compensate for a hairpin dispersion of a flatness test result received from the flatness tester 150.

The present disclosure attempts to provide a hairpin coil flattening control system and a method therefor that are capable of controlling an amount of pressing of individual flattening rollers to be automatically set reference graph of an amount of pressing flat rectangular based on a calculation method of an optimal amount of pressing for each LOT of flat rectangular coils using a reference graph of an amount of pressing for each LOT of bobbins loaded into a flat rectangular hairpin production facility.

According to one example of the present disclosure, a hairpin coil flattening control system applied to a production facility for a flat rectangular hairpin, the hairpin coil flattening control system includes: an unwinding unit configured to unwind the flat rectangular coil wound on a bobbin; a flattening device configured to perform a flattening operation by passing the flat rectangular coil through flattening rollers disposed in plural respectively on upper and lower sides and left and right sides along a lengthwise direction of the flat rectangular coil; a shaping device configured to form the flattened coil into a "U" shaped hairpin coil; a reader configured to recognize LOT information by scanning an identification code of the bobbin mounted on the unwinding unit; and a controller configured to store a reference graph of an amount of pressing for each LOT of bobbins set by testing and selectively controlling an amount of pressing of an individual flattening roller by calculating an amount of pressing by considering a change in physical properties of the corresponding flat rectangular coil based on the reference graph of an amount of pressing for each LOT upon receiving the LOT information from the reader.

In addition or alternative, the reference graph of an amount of pressing for each LOT of the bobbin may be generated as a graph including an optimal target yield strength for each LOT by analyzing yield data according to the amount of pressing of the flat rectangular coil for each LOT after performing a tensile test of the flat rectangular coil for each LOT of various bobbins.

In addition or alternative, the flattening device may include: a first flattening unit having a plurality of flattening rollers disposed horizontally on upper and lower portions thereof based on a thickness of the flat rectangular coil and configured to flatten upper and lower surfaces of the flat rectangular coil; and a second flattening unit having a plurality of flattening rollers disposed horizontally on left and right portions thereof based on a width of the flat rectangular coil and configured to flatten left and right surfaces of the flat rectangular coil.

In addition or alternative, the first flattening unit may include: a plurality of first flattening rollers positioned on an upper portion of the flat rectangular coil; an individual adjuster installed on each of the plurality of first flattening rollers to independently adjust a position of each of the plurality of first flattening rollers; a plurality of second flattening rollers positioned on a lower portion of the flat rectangular coil; and an integrated adjuster configured to simultaneously adjust positions of the plurality of second flattening rollers.

In addition or alternative, the individual adjuster may adjust the corresponding first flattening roller to an amount of pressing in units of micrometers in response to a control signal applied from the controller through a servo motor.

In addition or alternative, the integrated adjuster may connect the plurality of second flattening rollers in parallel through a frame rod and adjust the plurality of second flattening rollers simultaneously to be raised to a coil clamp position or lowered to a coil unclamp position in response to an applied control signal.

In addition or alternative, the controller may derive an initial yield strength of the flat rectangular coil based on LOT information on the bobbin, derive a target yield strength corresponding to the LOT information by referring to the reference graph of an amount of pressing for each LOT, and determine a maximum amount of pressing of an individual roller by calculating a deviation of the initial yield strength from the target yield strength.

In addition or alternative, in a state of fixing the plurality of second flattening rollers disposed on the lower portion of the flat rectangular coil in the clamp position, the controller may control a first roller based on the direction of coil feeding among the plurality of first flattening rollers disposed on the upper portion of the flat rectangular coil to the maximum amount of pressing, and subsequently control the remaining rollers to a nominal value (0 mm) considering a thickness of the corresponding flat rectangular coil.

In addition or alternative, in a state of fixing the plurality of second flattening rollers disposed on the lower portion of the flat rectangular coil in the clamp position, the controller may control a first roller based on the direction of coil feeding among the plurality of first flattening rollers disposed on the upper portion of the flat rectangular coil to the maximum amount of pressing, controls subsequent rollers to the nominal value (0 mm) considering a thickness of the corresponding flat rectangular coil, and control a last roller with a fine-adjusted amount of pressing.

Meanwhile, a hairpin coil flattening control method of a controller applied to a production facility for a flat rectangular hairpin, according one example of the present disclosure, the hairpin coil flattening control method includes: identifying information on physical properties of the flat rectangular coil by receiving LOT information on a bobbin mounted on an unwinding unit from a reader; disposing a plurality of flattening rollers at clamp positions of upper and lower sides and left and right sides considering a thickness and a width of the flat rectangular coil through a flattening device; deriving a target yield strength corresponding to the LOT information by identifying an initial yield strength of a coil based on the LOT information and referring to a reference graph of an amount of pressing that is set for each LOT of a bobbin; and determining a maximum amount of pressing of an individual roller by calculating a deviation of the initial yield strength from the target yield strength, and controlling an amount of pressing of an individual flattening roller based on the maximum amount of pressing.

In addition or alternative, the disposing of the plurality of flattening rollers at the clamp positions may include: disposing horizontally a plurality of first flattening rollers on an upper portion of the flat rectangular coil through individual adjusters; and disposing a plurality of second flattening rollers horizontally on a lower portion of the flat rectangular coil by collectively raising the plurality of second flattening rollers through an integrated adjuster.

In addition or alternative, the controlling of the amount of pressing of the individual flattening roller may include: fixing the plurality of second flattening rollers disposed at the lower portion of the flat rectangular coil to the clamp positions at a nominal value (0 mm) through the integrated adjuster; and controlling a first roller based on the direction of coil feeding among the plurality of first flattening rollers disposed on the upper portion of the flat rectangular coil to the maximum amount of pressing through the individual adjuster and subsequently controlling the remaining rollers to the nominal value (0 mm) considering a thickness of the corresponding flat rectangular coil.

In addition or alternative, the hairpin coil flattening control method may further include: after the controlling of the remaining rollers to the nominal value (0 mm) considering the thickness of the corresponding flat rectangular coil, controlling a fine-adjusted amount of pressing of a last roller of the plurality of first flattening rollers in order to compensate for a hairpin dispersion of a flatness test result received from a flatness tester.

According to an example of the present disclosure, there is an effect of stabilizing the hairpin shaping quality by automatically controlling the amount of pressing of individual flattening rollers by calculating an optimal amount of pressing considering the yield strength of the flat rectangular coil for each LOT of bobbins input to the production facility for a flat rectangular hairpin.

There may be an effect of flattening the flat rectangular coil and reducing the shaping dispersion by minimizing the spring back that affects the shapeability through the control of physical properties by calculating the optimal amount of pressing by considering the yield strength of the flat rectangular coil.

There may be an effect of standardizing a setting operation for flattening rollers between different facilities by presenting a standard that enables calibration of the amount of pressing of the flattening rollers which is set without requiring to apply individual standards for each company/facility based on the reference graph of an amount of pressing for each LOT of bobbins generated through a test.

As described above, according to an example of the present disclosure, there is an effect of stabilizing the hairpin shaping quality by automatically controlling the amount of pressing of individual flattening rollers by calculating an optimal amount of pressing considering the yield strength of the flat rectangular coil for each LOT of bobbins loaded into the production facility for a flat rectangular hairpin.

There may be an effect of flattening the flat rectangular coil and reducing the shaping dispersion by minimizing the spring back that affects the shapeability through the control of physical properties by calculating the optimal amount of pressing by considering the yield strength of the flat rectangular coil.

There may be an effect of standardizing a setting operation for flattening rollers between different facilities by presenting a standard that enables calibration of the amount of pressing of the flattening rollers which is set without requiring individual standards for each company/facility based on the reference graph of an amount of pressing for each LOT of bobbins generated through a test.

The example of the present disclosure is not implemented only by an apparatus and a method. Based on the above-mentioned descriptions of the examples, those skilled in the art to which the present disclosure pertains may easily realize the examples through programs for realizing functions corresponding to the configuration of the example of the present disclosure or recording media on which the programs are recorded.

Although the examples of the present disclosure have been described in detail hereinabove, the right scope of the present disclosure is not limited thereto, and it should be clearly understood that many variations and modifications made by those skilled in the art using the basic concept of the present disclosure, which is defined in the following claims, will also belong to the right scope of the present disclosure.

What is claimed is:

1. A system for processing a rectangular material from a coil, the system comprising:

an unwinding unit configured to unwind a rectangular material from a coil wound on a bobbin;

a flattening device configured to flatten, based on passing the unwound rectangular material through flattening rollers, the unwound rectangular material, wherein the flattening rollers are positioned on upper and lower sides of the unwound rectangular material and on left and right sides along a lengthwise direction of the unwound rectangular material;

a shaping device configured to transform the flattened rectangular material into a "U" shaped hairpin configuration;

a reader configured to recognize, based on scanning an identification code of the bobbin mounted on the unwinding unit, batch information; and a controller configured to:

store, based on the batch information, a reference graph of a pressing amount for each batch of the bobbin set through a test;

calculate, based on the stored reference graph and a change in physical properties of the rectangular material, a pressing amount for the rectangular material; and selectively control, based on the calculated pressing amount, a pressing amount of an individual flattening roller of the flattening rollers.

2. The system of claim 1, wherein the controller is further configured to:

based on the test for the each batch and the pressing amount of the rectangular material, analyze yield data; and based on the analyzed yield data, generate the reference graph as a graph including an optimal target yield strength for the each batch.

3. The system of claim 1, wherein the flattening device comprises:

a first flattening unit having a first plurality of flattening rollers disposed based on a thickness of the rectangular material, wherein the first plurality of flattening rollers are configured to flatten upper and lower surfaces of the rectangular material; and a second flattening unit having a second plurality of flattening rollers disposed based on a width of the rectangular material, wherein the second plurality of flattening rollers are configured to flatten left and right surfaces of the rectangular material.

4. The system of claim 3, wherein the first plurality of flattening rollers comprises:

a plurality of first flattening rollers positioned on an upper portion of the rectangular material;

an individual adjuster installed on each of the plurality of first flattening rollers to independently adjust a position of each of the plurality of first flattening rollers;

a plurality of second flattening rollers positioned on a lower portion of the rectangular material; and an integrated adjuster configured to simultaneously adjust positions of the plurality of second flattening rollers.

5. The system of claim 4, wherein the individual adjuster is configured to adjust, based on a control signal applied from the controller through a servo motor, a flattening roller to a pressing amount in units of micrometers.

6. The system of claim 4, wherein the integrated adjuster is configured to:

connect the plurality of second flattening rollers in parallel through a frame rod; and adjust, based on an applied control signal, the plurality of second flattening rollers simultaneously to be raised to a clamp position or lowered to an unclamp position.

7. The system according to claim 1, wherein the controller is configured to:

derive, based on the batch information, an initial yield strength of the rectangular material;

derive, based on the reference graph, a target yield strength corresponding to the batch information; and determine, based on a deviation of the initial yield strength from the target yield strength, a maximum pressing amount of an individual roller.

8. The system of claim 7, wherein the controller, in a state of a plurality of flattening rollers, positioned on the lower side of the rectangular material, fixed in a clamp position, is configured to:

based on a direction of the rectangular material feeding among a plurality of flattening rollers positioned on the upper side of the rectangular material, control a first roller to apply the maximum pressing amount; and subsequently control, based on a thickness of the rectangular material, the remaining rollers of the plurality of flattening rollers disposed on the upper side of the rectangular material, to apply a pressing amount of a nominal value.

9. The system of claim 7, wherein the controller, in a state of a plurality of flattening rollers, positioned on the lower side of the rectangular material, fixed in a clamp position, is configured to:

based on a direction of the rectangular material feeding among a plurality of first flattening rollers positioned on the upper side of the rectangular material, control a first roller to apply the maximum pressing amount;

control, based on a thickness of the rectangular material subsequent rollers of the plurality of first flattening rollers positioned on the upper side to apply a pressing amount of a nominal value; and control, based on a fine-adjusted pressing amount, a last roller of the plurality of first flattening rollers positioned on the upper side.

10. A method for processing a rectangular material from a coil, the method comprising:

identifying, by a reader and based on batch information on a bobbin, information on physical properties of the rectangular material;

disposing, based on a thickness and a width of the rectangular material, a plurality of flattening rollers at clamp positions of upper and lower sides of the rectangular material and left and right sides of the rectangular material;

based on an initial yield strength of the coil based on the batch information and a reference graph of a pressing amount for each batch of the bobbin, deriving a target yield strength corresponding to the batch information;

determining, based on a deviation of the initial yield strength from the target yield strength, a maximum pressing amount of an individual flattening roller of the plurality of flattening rollers; and controlling, based on the maximum pressing amount, the individual flattening roller.

11. The method of claim 10, wherein the disposing of the plurality of flattening rollers at the clamp positions comprises:

disposing horizontally a plurality of first flattening rollers on the upper side of the rectangular material through individual adjusters; and disposing a plurality of second flattening rollers horizontally on the lower side of the rectangular material by collectively raising the plurality of second flattening rollers through an integrated adjuster.

12. The method of claim 11, wherein the controlling the individual flattening roller comprises:

fixing, through the integrated adjuster, the plurality of second flattening rollers to apply a pressing amount of a nominal value; and based on a direction of the rectangular material feeding among the plurality of first flattening rollers, controlling, through the individual adjusters, a first roller of the plurality of first flattening rollers to apply the maximum pressing amount; and subsequently controlling, based on the thickness of the rectangular material, the remaining rollers of the plurality of first flattening rollers to apply a pressing amount of a nominal value.

13. The method of claim 12, further comprising:

based on the controlling of the remaining rollers and controlling of a fine-adjusted amount of pressing of a last roller of the plurality of first flattening rollers, compensating for a hairpin dispersion of a flatness test result received from a flatness tester.

14. An apparatus comprising:

a plurality of flattening rollers configured to flatten a rectangular material unwound from a coil wound on a bobbin, wherein the plurality of flattening rollers are positioned on upper and lower sides of the unwound rectangular material and on left and right sides along a lengthwise direction of the unwound rectangular material;

a mold configured to transform the flattened rectangular material into a hairpin configuration;

a reader configured to recognize, based on scanning an identification code of the bobbin, batch information; and a controller configured to:

store, based on the batch information, a reference graph of a pressing amount for each batch of the bobbin set through a test;

calculate, based on the stored reference graph and a change in physical properties of the rectangular material, a pressing amount for the rectangular material; and selectively control, based on the calculated pressing amount, a pressing amount of an individual flattening roller of the plurality of flattening rollers.

15. The apparatus of claim 14, wherein the controller is further configured to:

based on the test for the each batch and the pressing amount of the rectangular material, analyze yield data; and based on the analyzed yield data, generate the reference graph as a graph including an optimal target yield strength for the each batch.

16. The apparatus of claim 14, wherein the plurality of flattening rollers comprise:

a first plurality of flattening rollers disposed based on a thickness of the rectangular material, wherein the first plurality of flattening rollers are configured to flatten upper and lower surfaces of the rectangular material; and a second plurality of flattening rollers disposed based on a width of the rectangular material, wherein the second plurality of flattening rollers are configured to flatten left and right surfaces of the rectangular material.

17. The apparatus of claim 16, wherein the first plurality of flattening rollers comprises:

a plurality of first flattening rollers positioned on an upper portion of the rectangular material;

an individual adjuster installed on each of the plurality of first flattening rollers to independently adjust a position of each of the plurality of first flattening rollers;

a plurality of second flattening rollers positioned on a lower portion of the rectangular material; and an integrated adjuster configured to simultaneously adjust positions of the plurality of second flattening rollers.

18. The apparatus of claim 17, wherein the individual adjuster is configured to adjust, based on a control signal applied from the controller through a servo motor, a flattening roller to a pressing amount in units of micrometers.

19. The apparatus of claim 17, wherein the integrated adjuster is configured to:

connect the plurality of second flattening rollers in parallel through a frame rod; and adjust, based on an applied control signal, the plurality of second flattening rollers simultaneously to be raised to a clamp position or lowered to an unclamp position.

20. The apparatus of claim 14, wherein the controller is configured to:

derive, based on the batch information, an initial yield strength of the rectangular material;

derive, based on the reference graph, a target yield strength corresponding to the batch information; and determine, based on a deviation of the initial yield strength from the target yield strength, a maximum pressing amount of an individual roller.

* * * * *